US009455081B2

(12) United States Patent
Tseng

(10) Patent No.: US 9,455,081 B2
(45) Date of Patent: Sep. 27, 2016

(54) METHOD OF PRODUCING AN INDUCTOR WITH A HIGH INDUCTANCE

(71) Applicant: CYNTEC CO., LTD., Hsinchu (TW)

(72) Inventor: Shih-Hsien Tseng, Hsinchu County (TW)

(73) Assignee: CYNTEC Co., Ltd., Hsinchu (TW)

( * ) Notice: Subject to any disclaimer, the term of this patent is extended or adjusted under 35 U.S.C. 154(b) by 16 days.

(21) Appl. No.: 14/061,774

(22) Filed: Oct. 24, 2013

(65) Prior Publication Data

US 2014/0049350 A1 Feb. 20, 2014

Related U.S. Application Data

(63) Continuation of application No. 13/302,862, filed on Nov. 22, 2011, now Pat. No. 8,601,673.

(60) Provisional application No. 61/417,221, filed on Nov. 25, 2010.

(51) Int. Cl.

| | |
|---|---|
| ***H01F 5/00*** | (2006.01) |
| ***H01F 27/28*** | (2006.01) |
| ***H01F 41/04*** | (2006.01) |

(52) U.S. Cl.

CPC ..... *H01F 27/2804* (2013.01); *H01F 41/046* (2013.01); *Y10T 29/4902* (2015.01); *Y10T 29/49069* (2015.01); *Y10T 29/49071* (2015.01); *Y10T 29/49073* (2015.01); *Y10T 29/49075* (2015.01)

(58) Field of Classification Search

CPC ..... H01F 5/00; H01F 27/00–27/30
USPC ..... 336/65, 83, 200, 206–208, 232
See application file for complete search history.

(56) References Cited

U.S. PATENT DOCUMENTS

| | | | | |
|---|---|---|---|---|
| 5,760,669 | A * | 6/1998 | Dangler et al. | 336/65 |
| 6,628,531 | B2 * | 9/2003 | Dadafshar | 361/836 |
| 6,980,074 | B1 * | 12/2005 | Jitaru | 336/200 |
| 7,427,909 | B2 * | 9/2008 | Ono | H01F 1/1475 336/90 |
| 2003/0048167 | A1 * | 3/2003 | Inoue | H01F 17/0013 336/200 |

* cited by examiner

*Primary Examiner* — Tuyen Nguyen
(74) *Attorney, Agent, or Firm* — Min-Lee Teng; Litron Patent & Trademark Office

(57) ABSTRACT

A method of producing an inductor with high inductance includes forming a removable polymer layer on a temporary carrier; forming a structure including a first coil, a second coil, and a dielectric layer on the removable polymer layer; forming a first magnetic glue layer on the removable polymer layer and the structure; removing the temporary carrier; and forming a second magnetic glue layer below the structure and the first magnetic glue layer.

6 Claims, 19 Drawing Sheets

METHOD OF PRODUCING AN INDUCTOR WITH A HIGH INDUCTANCE

CROSS-REFERENCE TO RELATED APPLICATIONS

This application is a continuation of U.S. application Ser. No. 13/302,862, filed on Nov. 22, 2011, which claims priority under 35 U.S.C. §119(e) to U.S. Provisional Application No. 61/417,221, filed on Nov. 25, 2010, the entire contents of each application are hereby incorporated by reference.

BACKGROUND OF THE INVENTION

1. Field of the Invention

The present invention relates to a method of producing an inductor, and more particularly to a method of producing an inductor that utilizes a temporary carrier and a removable polymer layer to produce an inductor with high inductance.

2. Background of the Invention

In a conventional inductor, a traditional magnetic substrate is used as a carrier, and a dielectric layer, coils, and a magnetic glue, etc. are formed on the traditional magnetic substrate. The dielectric layer covers the coils, and the magnetic glue covers the dielectric layer. However, when the traditional magnetic substrate operates at a high frequency, both permeability and permeability loss of the traditional magnetic substrate becomes worse with the increase of an operation frequency.

Therefore, in Universal Serial Bus (USB) 2.0, USB 3.0, High-definition Multimedia Interface (HDMI) and/or Mobile Industry Processor Interface (MIPI) applications, the traditional magnetic substrate may reduce the cut-off frequency of the inductor. Therefore, the conventional inductor with a traditional magnetic substrate may not meet a requirement of an integrated circuit designer.

SUMMARY OF THE INVENTION

Accordingly, it is an object of the present invention to provide a method of producing an inductor with high inductance.

To achieve the above-mentioned object, according to one aspect of the present invention, a method of producing an inductor with high inductance, comprises: forming a removable polymer layer on a temporary carrier; forming a structure including a first coil, a second coil, and a dielectric layer on the removable polymer layer; forming a first magnetic glue layer on the removable polymer layer and the structure; removing the temporary carrier; and forming a second magnetic glue layer below the structure and the first magnetic glue layer.

In one embodiment, an electronic component is disclosed, wherein the electronic component comprises: at least one conductive element; and a plurality of insulating layers, wherein the at least one conductive element is disposed in the plurality of insulating layers, wherein the plurality of insulating layers are not supported by a substrate.

In one embodiment, in the electronic component described above, the plurality of insulating layers comprise a top insulating layer, a plurality of median insulating layers and a bottom insulation layer, wherein at least one conductive element are substantially disposed in the plurality of the median insulating layers. In one embodiment, the at least one conductive element comprises a first coil and a second coil. In one embodiment, the top insulating layer is a first magnetic glue layer; and the bottom insulation layer is a second magnetic glue layer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE ILLUSTRATED EMBODIMENTS

Figure 1:
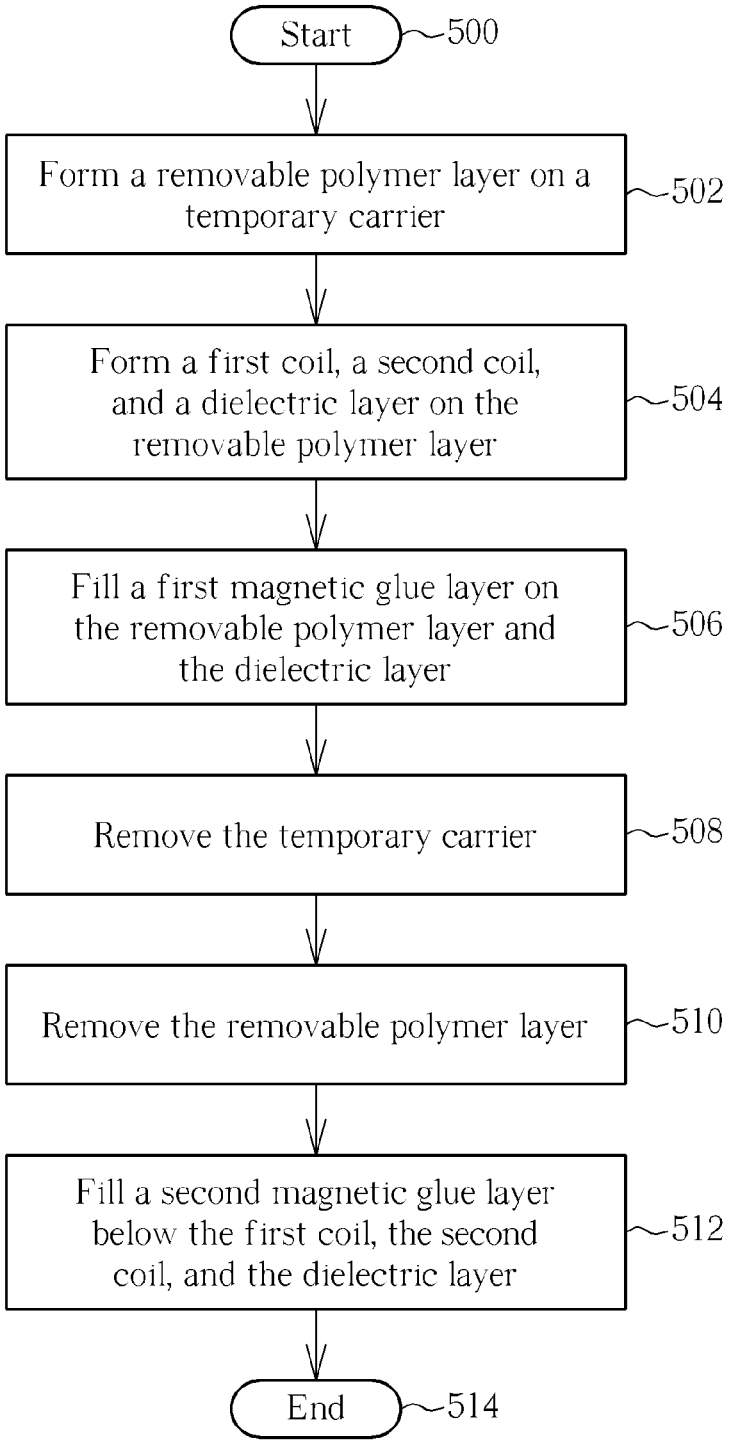
FIG. 1 is a flowchart illustrating a method of producing an inductor with high inductance according to an embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

FIG. 1 is a flowchart illustrating a method of producing an inductor 600 with high inductance according to an embodiment of the present invention. Detailed steps of the method of FIG. 1 are explained as follows:

Step 500: Start.

Step 502: Form a removable polymer layer 604 on a temporary carrier 602.

Step 504: Form a first coil 606, a second coil 608, and a dielectric layer 610 on the removable polymer layer 604.

Step 506: Fill a first magnetic glue layer 612 on the removable polymer layer 604 and the dielectric layer 610.

Step 508: Remove the temporary carrier 602.

Step 510: Remove the removable polymer layer 604.

Step 512: Fill a second magnetic glue layer 614 below the first coil 606, the second coil 608, and the dielectric layer 610.

Step 514: End.

Figure 2A:
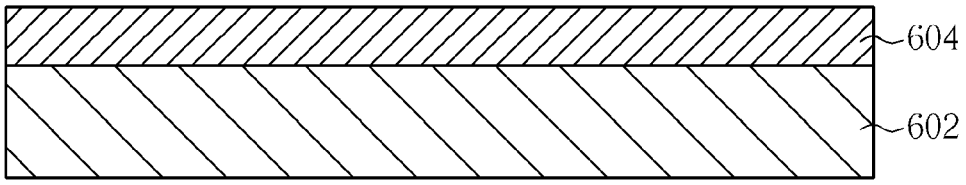
FIGS. 2A-2H are diagrams illustrating the method of FIG. 1.
Figure 2B:
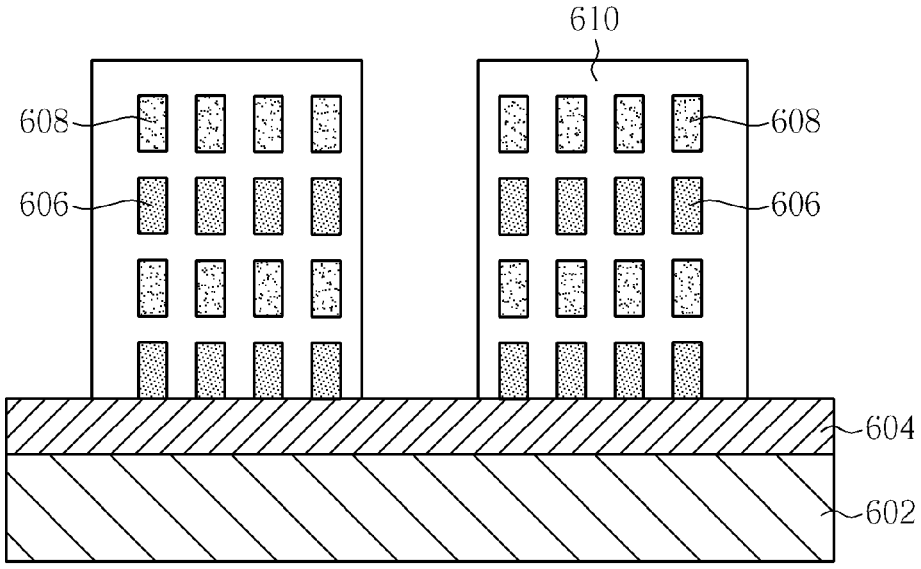

In Step 502 (as shown in FIG. 2A), the removable polymer layer 604 is formed on the temporary carrier 602. In Step 504 (as shown in FIG. 2B), a structure including the first coil 606, the second coil 608, and the dielectric layer 610 is formed on the removable polymer layer 604. The dielectric layer 610 is used to protect the first coil 606 and the second coil 608, and functions as a coupling layer between the first coil 606 and the second coil 608. In another embodiment of the present invention, the dielectric layer 610 covers the first coil 606 and the second coil 608, and the dielectric layer 610 further fills the inner sides of the first coil 606 and the second coil 608. More specifically, the dielectric layer 610 fully fills an inner area surrounded by the first coil 606 and the second coil 608. In still another embodiment of the present invention, the dielectric layer 610 covers the first coil 606 and the second coil 608, and the dielectric layer 610 further fills the outer sides of the first coil 606 and the second coil 608; however, the dielectric layer 610 does not fill the inner area surrounded by the first coil 606 and the second coil 608. In still another embodiment of the present invention, the dielectric layer 610 covers the first coil 606 and the second coil 608, and the dielectric layer 610 further fills both the inner sides and the outer sides of the first coil 606 and the second coil 608. In addition, the first coil 606, the second coil 608, and the dielectric layer 610 can be stacked in different manners as embodied in FIGS. 3A-3E FIG. 2B simply illustrates one way to perform Step 504 based on the stacked manner in FIG. 3A.

Figure 2C:
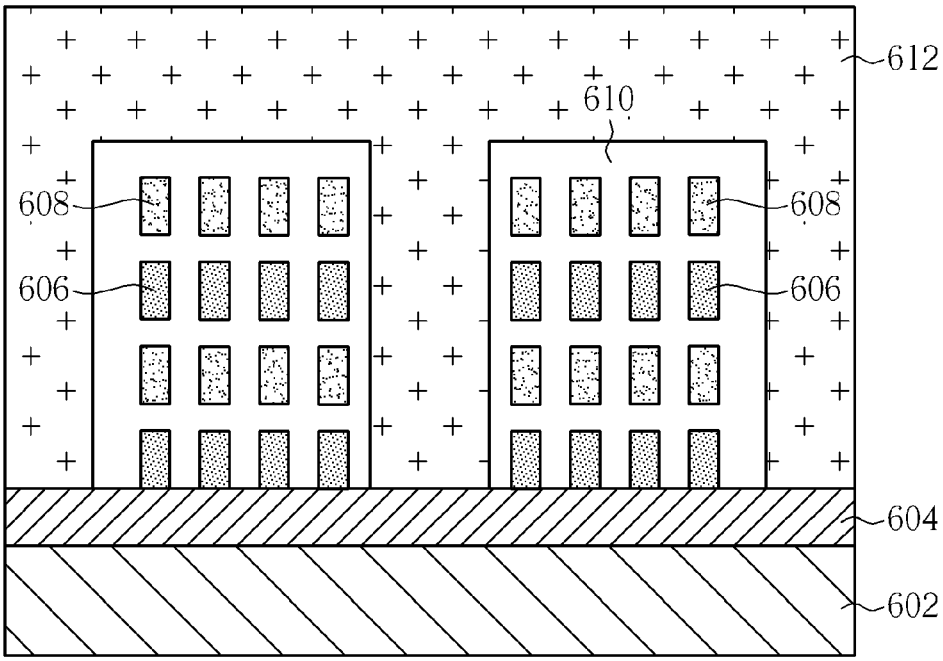

In Step 506 (as shown in FIG. 2C), the first magnetic glue layer 612 is filled/formed on the removable polymer layer 604 and the dielectric layer 610. In accordance with an embodiment of the present invention, the first magnetic glue layer 612 includes a plurality of magnetic particles and polymer based materials, and the plurality of magnetic particles of the first magnetic glue layer 612 include NiZn particles and/or MnZn particles. In an embodiment of the present invention, the grain size of the magnetic particles is smaller than 100 μm. Different magnetic material(s) may be filled/formed on the removable polymer layer 604 and the dielectric layer 610 in accordance with different embodiments of the present invention.

Figure 2D:
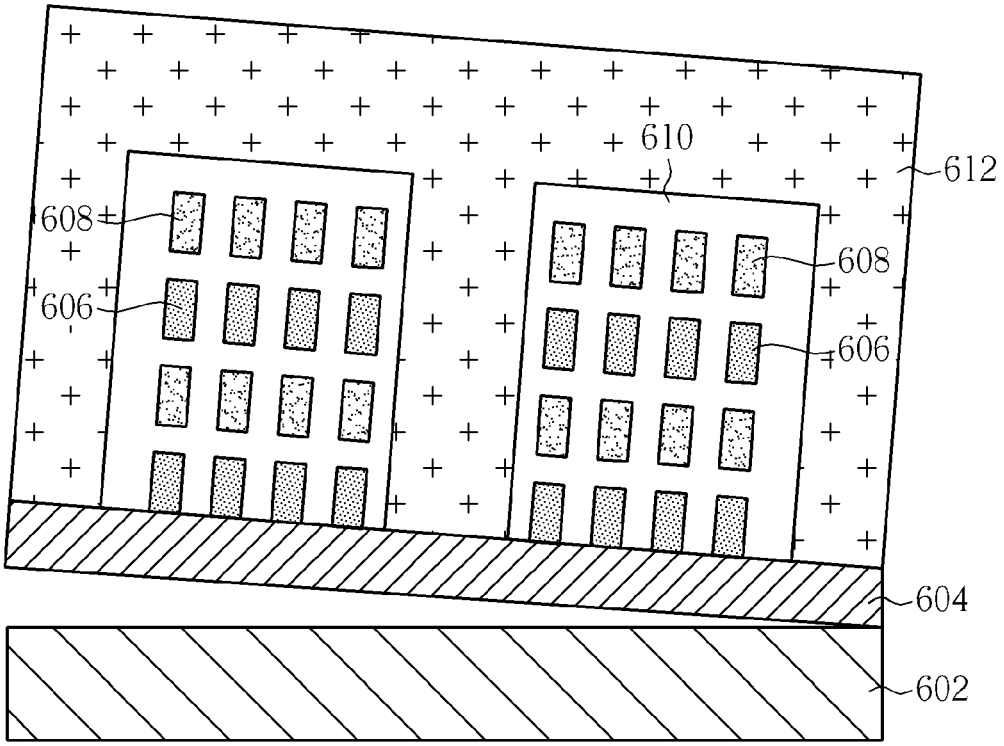
Figure 2E:
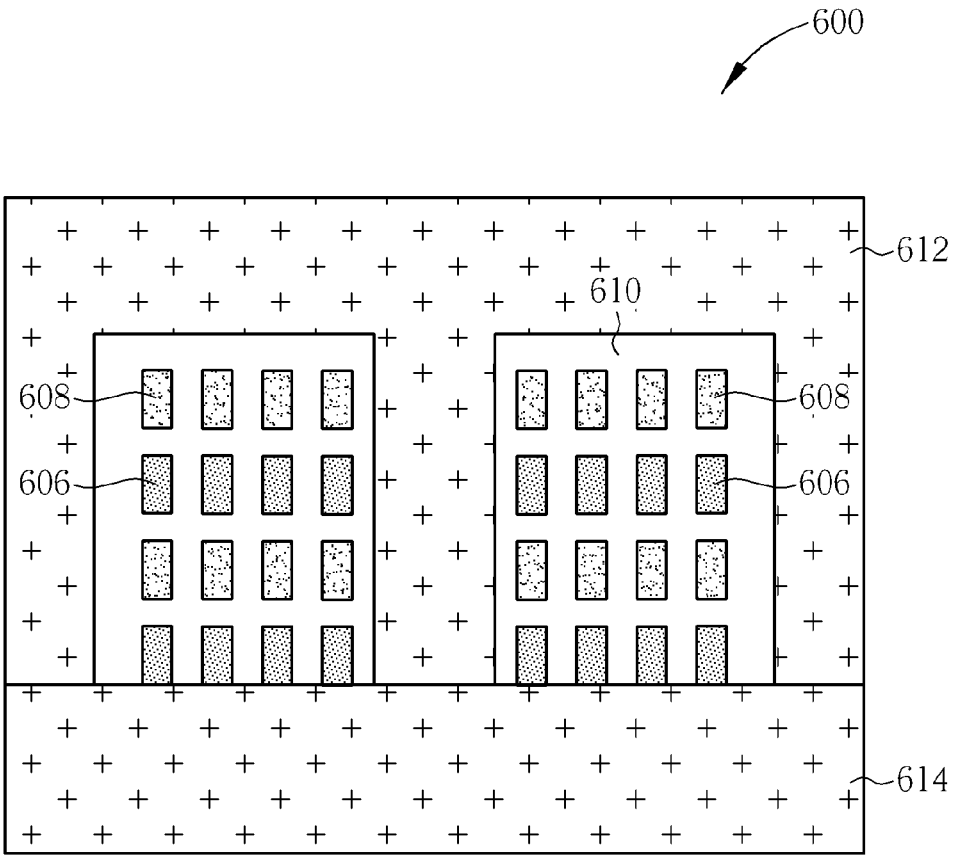
Figure 2F:
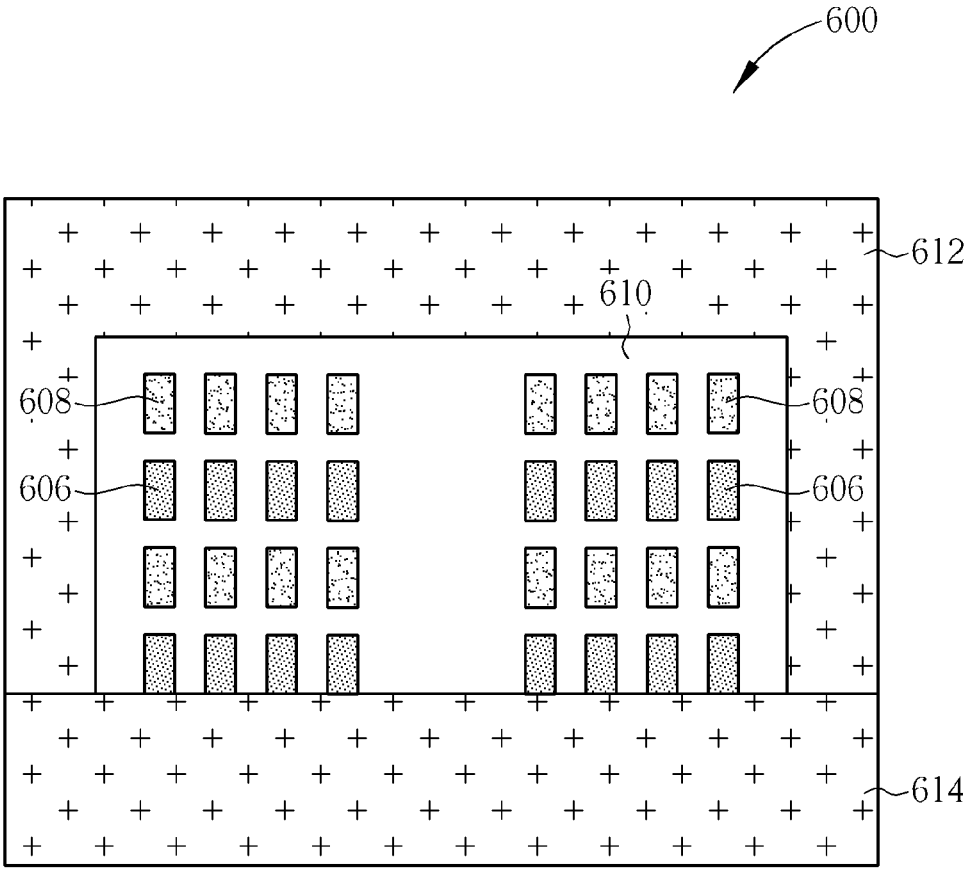
Figure 2G:
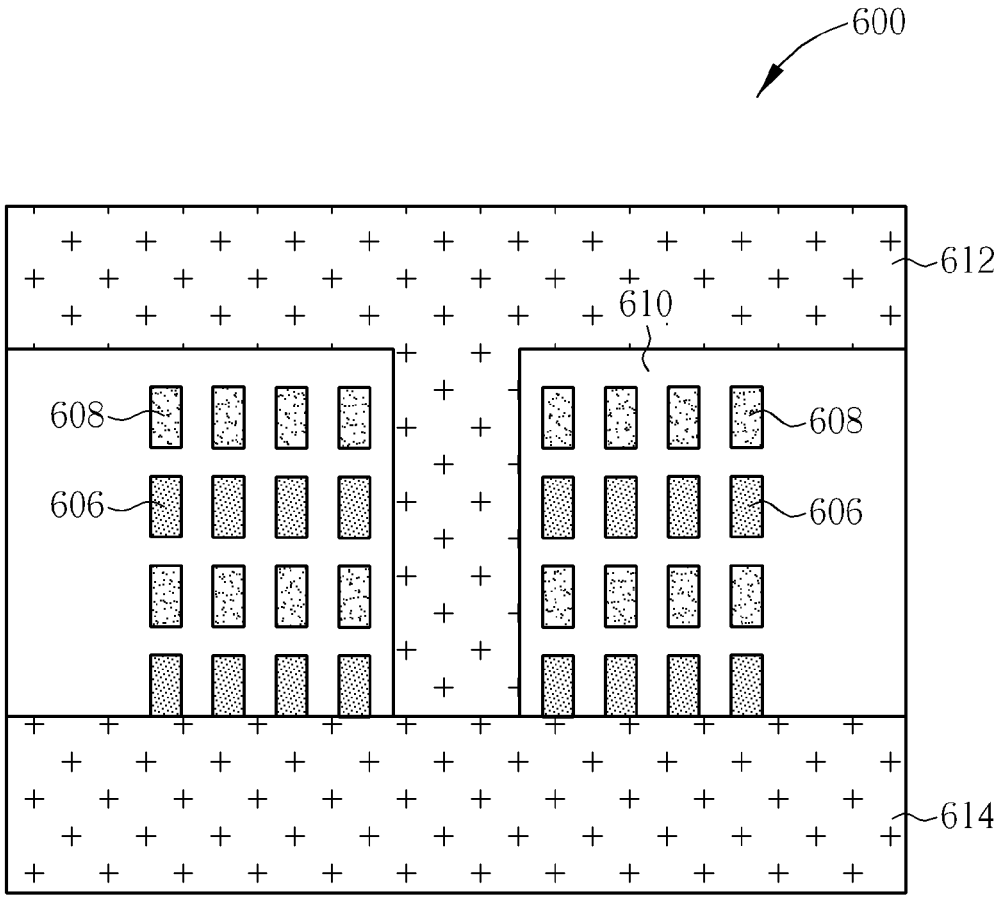
Figure 2H:
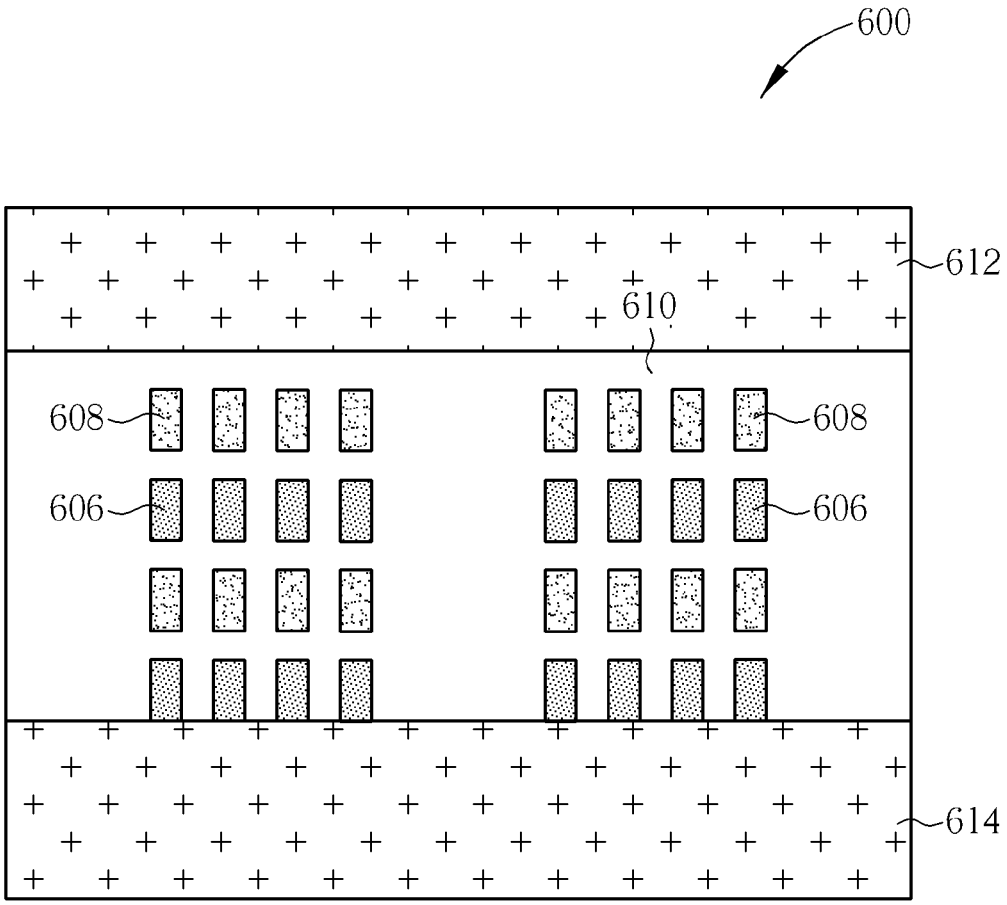

In Step 508 and Step 510 (as shown in FIG. 2D), the temporary carrier 602 and the removable polymer layer 604 located below the first coil 606, the second coil 608, and the dielectric layer 610 are removed. In Step 512 (as shown in FIG. 2E), after the temporary carrier 602 and the removable polymer layer 604 are removed, the second magnetic glue layer 614 is filled/formed below the first coil 606, the second coil 608, and the dielectric layer 610. In accordance with an embodiment of the present invention, the second magnetic glue layer 614 is the same as the first magnetic glue layer 612. That is to say, the second magnetic glue layer 614 also includes a plurality of magnetic particles and polymer based materials, such as, but not limited to epoxy or epoxy molding compounds (EMC). In addition, the plurality of magnetic particles of the second magnetic glue layer 614 also include NiZn particles and/or MnZn particles. In addition, a curing process will be performed on the first magnetic glue layer 612 and the second magnetic glue layer 614 to form the magnetic material formed of magnetic particles and cured polymer based materials. In an embodiment, after the first magnetic glue layer 612 is coated but before the second magnetic glue layer 614 is coated, a curing process can be performed on the first magnetic glue layer 612. Subsequently, after the second magnetic glue layer 614 is coated, another curing process can be performed on the second magnetic glue layer 614. In another embodiment, a pre-curing process can be first performed on the first magnetic glue layer 612 after the first magnetic glue layer 612 is coated but before the second magnetic glue layer 614 is coated. Subsequently, after the second magnetic glue layer 614 is coated, a curing process is performed on the pre-cured first magnetic glue layer 612 and the second magnetic glue layer 614, thereby forming the magnetic material formed of magnetic particles and cured polymer based materials. In addition, as mentioned, the grain size of the magnetic particles is smaller than 100 μm in the magnetic material formed of magnetic particles and cured polymer based materials. In another embodiment of the present invention, the second magnetic glue layer 614 is different from the first magnetic glue layer 612.

Figure 3A:
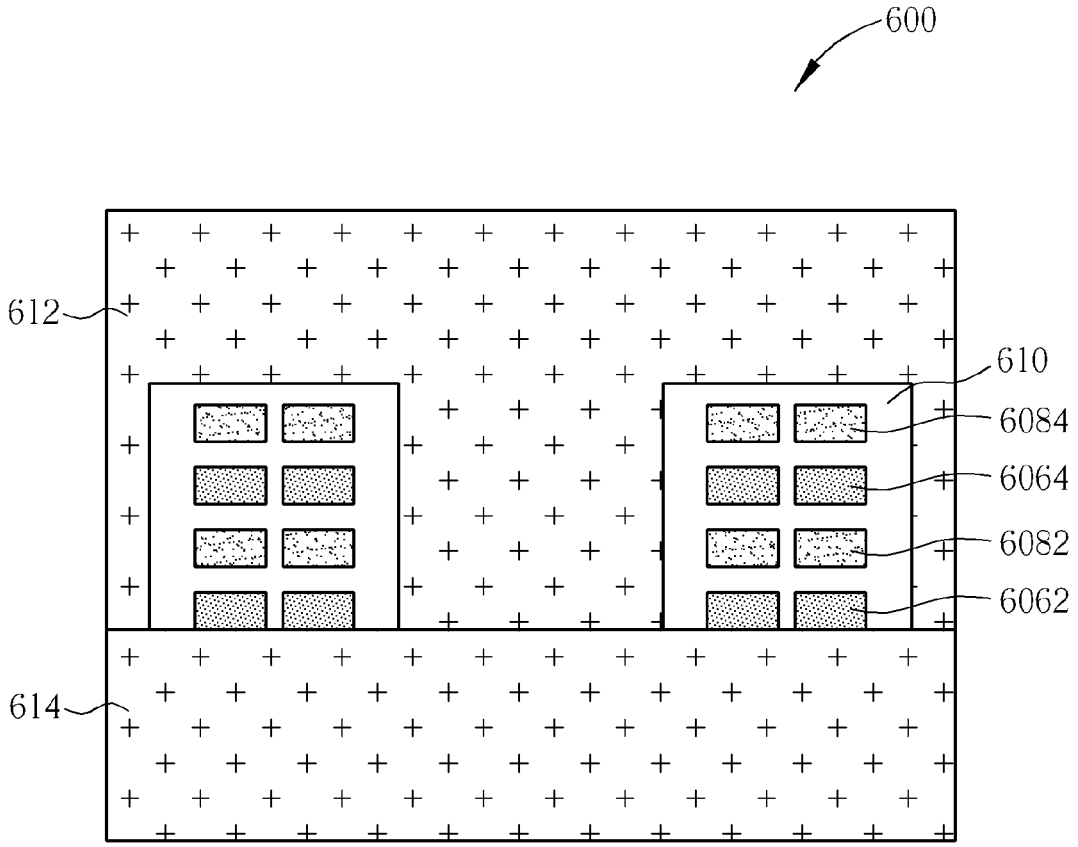
FIGS. 3A-3E are diagrams illustrating cross-sections of the inductor 600 produced according to the method of FIG. 1.
Figure 3B:
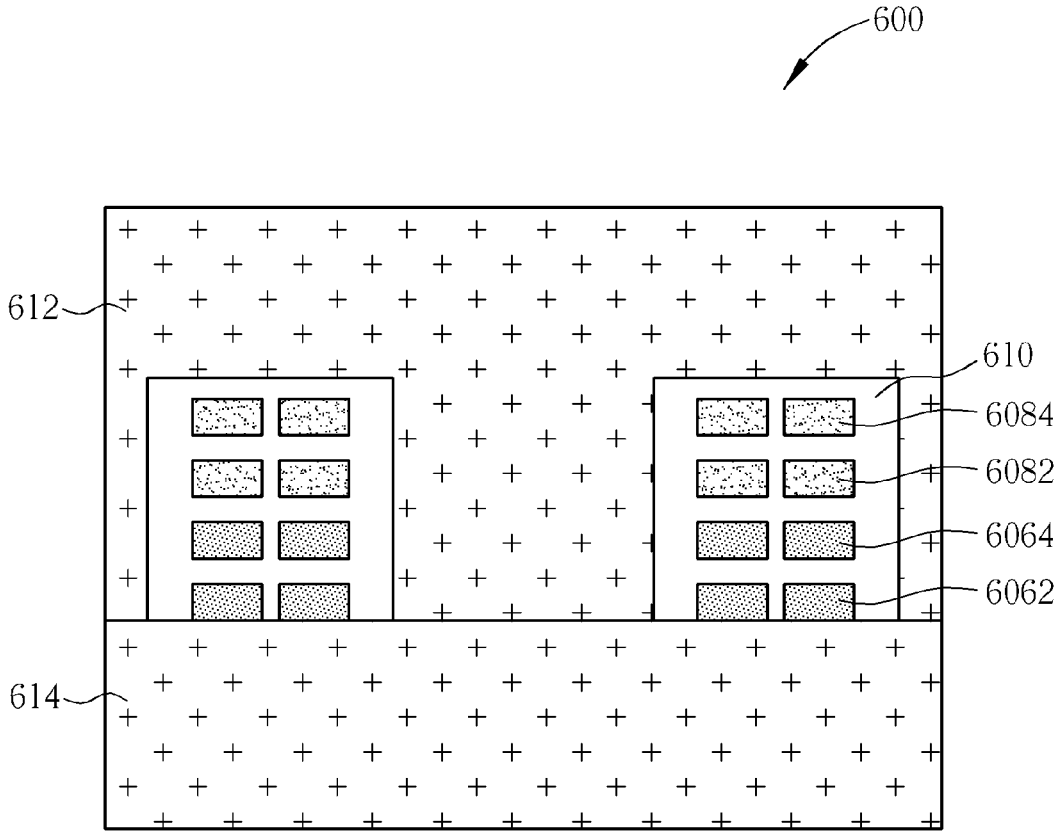
Figure 3C:
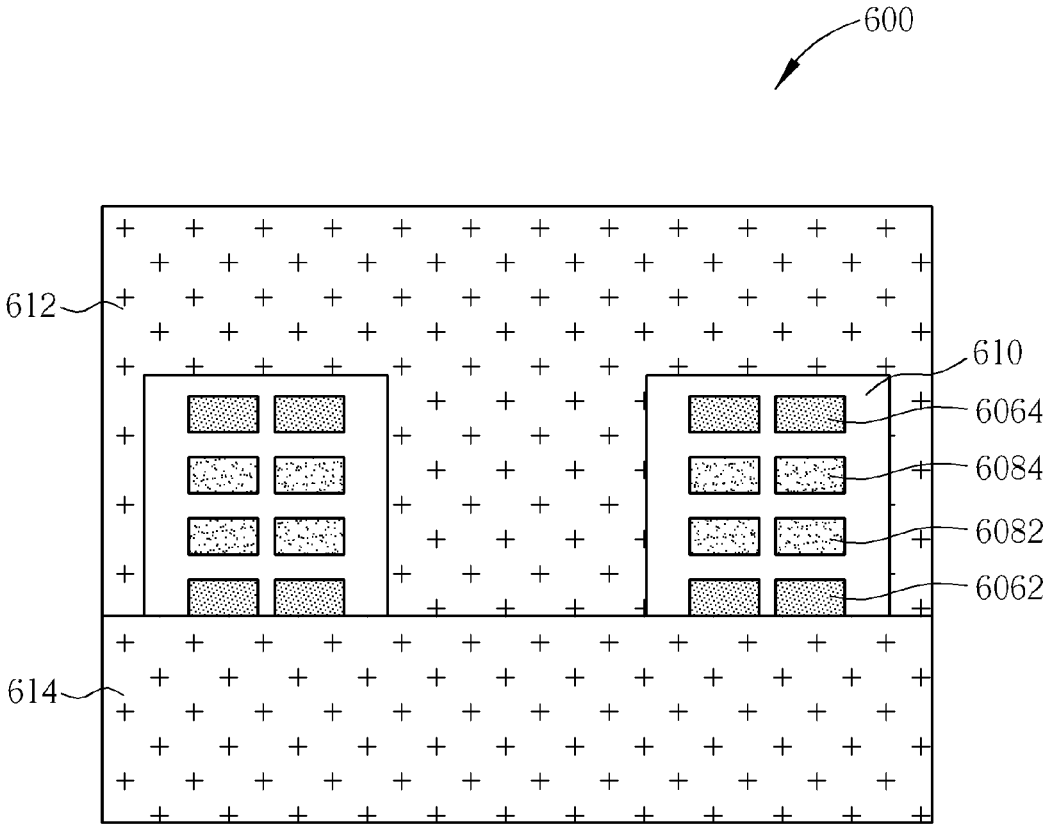
Figure 3D:
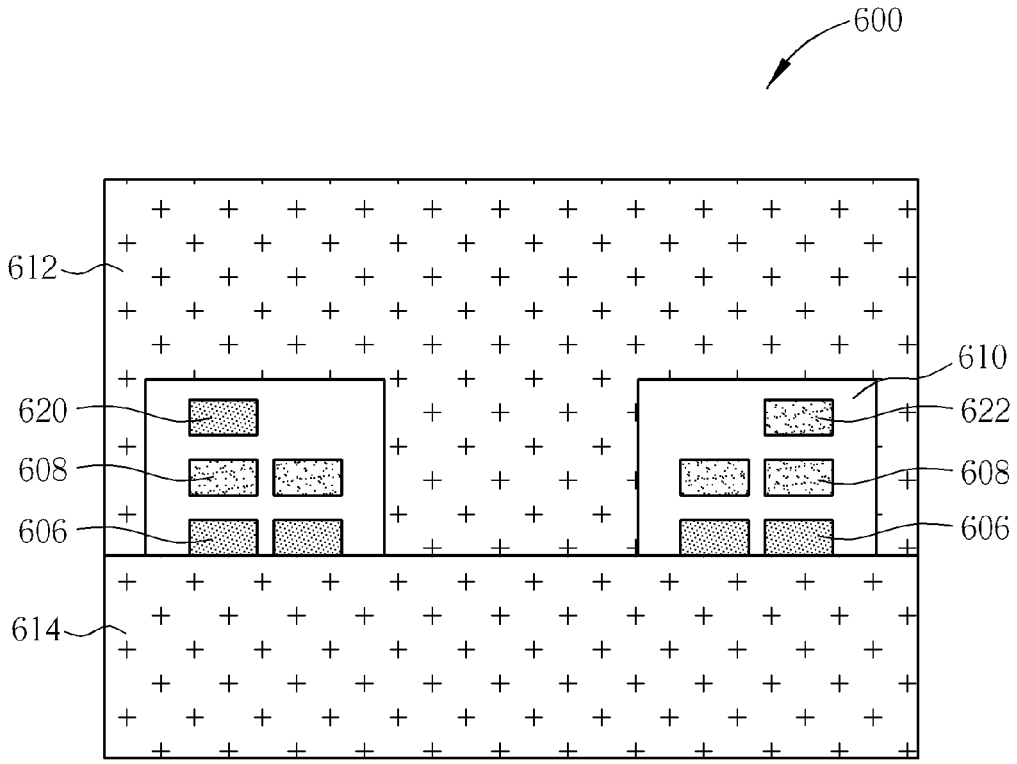
Figure 3E:
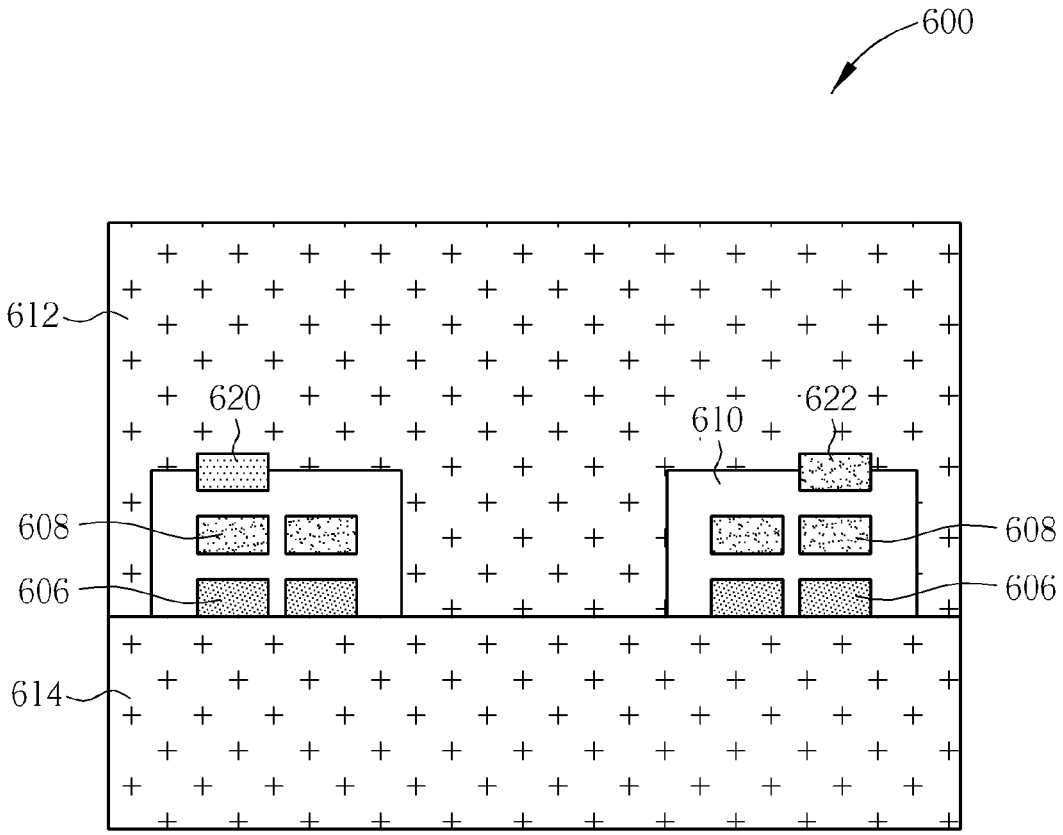

It is noticed that each coil pattern of the first coil 606 and the second coil 608 of the above mentioned embodiment is a spiral pattern located at the same membrane layer (as shown in FIGS. 3A-3C). In another embodiment, each coil pattern is a spiral pattern composed of sections located at different membrane layers. In still another embodiment, each coil pattern can include an upper pattern and a lower pattern stacked each other, a terminal of the upper pattern is electrically connected to a terminal of the lower pattern, another terminal of the upper pattern can be electrically connected to a corresponding via through a corresponding wire, and another terminal of the lower pattern can be electrically connected to a corresponding via through a corresponding wire (as shown in FIGS. 3D and 3E). Therefore, when differential-mode currents flow in the first coil 606 and the second coil 608 (i.e., the mutual magnetically coupling spiral conductor patterns), the respective magnetic flux of the first coil 606 and the second coil 608 cancel with each other in the spiral conductor patterns. When common-mode currents flow in the spiral conductor patterns, the respective magnetic flux of the first coil 606 and the second coil 608 in the spiral conductor patterns add up with each other.

Figure 4A:
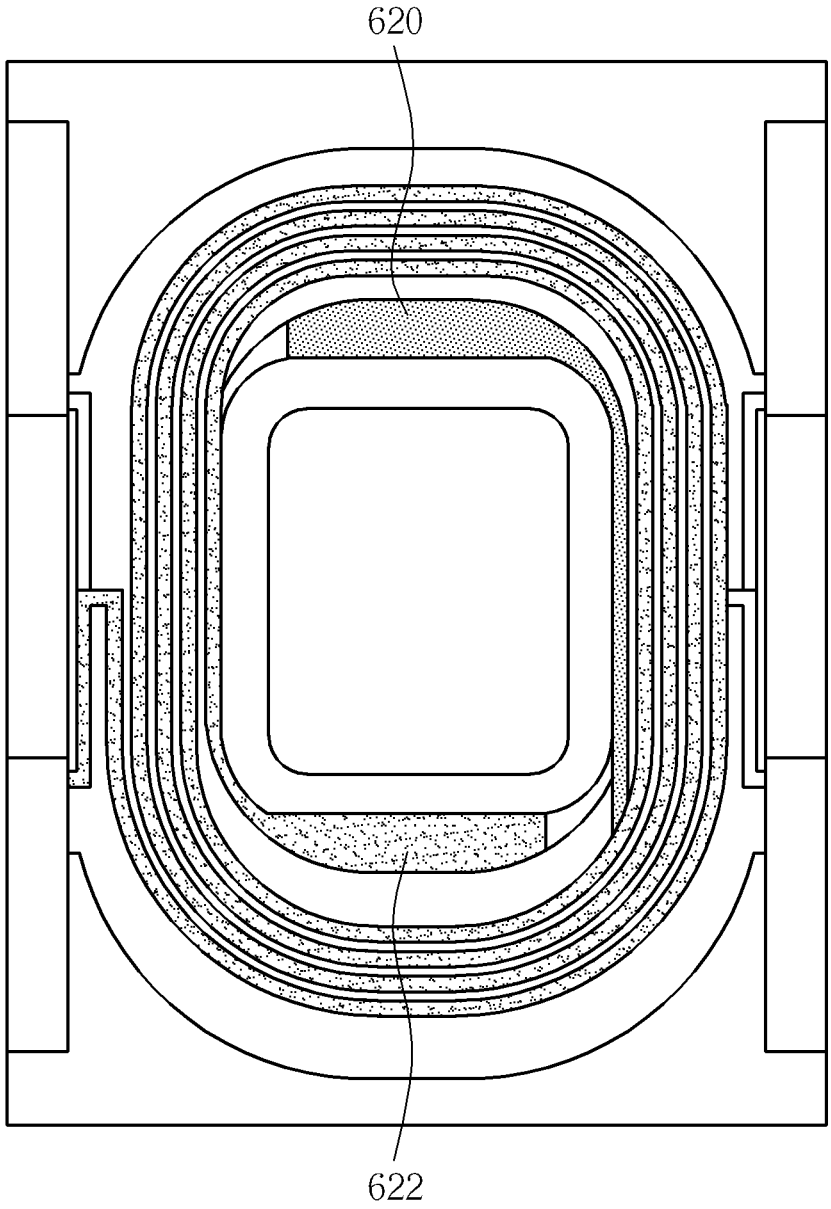
FIG. 4A is a diagram illustrating a corresponding top view of a layout of the inductor in FIGS. 3A-3C.

FIG. 4A is a diagram illustrating a corresponding top view of a layout of the inductor 600 in FIGS. 3A-3C, FIGS. 4B and 4C are diagrams illustrating corresponding top views of layouts of the inductor 600 in FIGS. 3D and 3E. As shown in FIG. 3A, the first coil 606 and the second coil 608 interlace with each other. That is to say, a first (bottom) layer 6082 of the second coil 608 is located above a first (bottom) layer 6062 of the first coil 606, a second (top) layer 6064 of the first coil 606 is located above the first (bottom) layer 6082 of the second coil 608, and a second (top) layer 6084 of the second coil 608 is located above the second (top) layer 6064 of the first coil 606. In addition, a bottom (i.e., the exposed bottom portion) of the first layer 6062 of the first coil 606 directly contacts the second magnetic glue layer 614, and the dielectric layer 610 fills/forms between the first layer 6082 of the second coil 608 and the first layer 6062 of the first coil 606, between the second layer 6064 of the first coil 606 and the first layer 6082 of the second coil 608, and between the second layer 6084 of the second coil 608 and the second layer 6064 of the first coil 606. In addition, except for the bottom of the first layer 6062 of the first coil 606, the dielectric layer 610 fully covers the first coil 606 and the second coil 608. As shown in FIG. 3B, the first (bottom) layer 6082 and the second (top) layer 6084 of the second coil 608 are located above the first (bottom) layer 6062 and the second (top) layer 6064 of the first coil 606, the bottom (i.e., the exposed bottom portion) of the first layer 6062 of the first coil 606 directly contacts the second magnetic glue layer 614, and the dielectric layer 610 fills/forms between the first layer 6062 and the second layer 6064 of the first coil 606, between the first layer 6082 and the second layer 6084 of the second coil 608, and between the second layer 6064 of the first coil 606 and the first layer 6082 of the second coil 608. In addition, except for the bottom of the first layer 6062 of the first coil 606, the dielectric layer 610 fully covers the first coil 606 and the second coil 608. As shown in FIG. 3C, the first (bottom) layer 6082 and the second (top) layer 6084 of the second coil 608 are located between the first (bottom) layer 6062 and the second (top) layer 6064 of the first coil 606, and the bottom (i.e., the exposed bottom portion) of the first layer 6062 of the first coil 606 directly contacts the second magnetic glue layer 614. The dielectric layer 610 fills/forms between the first (bottom) layer 6082 of the second coil 608 and the first (bottom) layer 6062 of the first coil 606, between the second layer (top) 6084 and the first (bottom) layer 6082 of the second coil 608, and between the second (top) layer 6064 of the first coil 606 and the second (top) layer 6084 of the second coil 608. In addition, except for the bottom of the first layer 6062 of the first coil 606, the dielectric layer 610 fully covers the first coil 606 and the second coil 608. As shown in FIGS. 3A-3C, the dielectric layer 610 protects the first coil 606 and the second coil 608, and functions as a coupling layer between the first coil 606 and the second coil 608. As shown in FIG. 4A, in the top view of the layout of the inductor 600, a first via 620 coupled to the first coil 606 and a second via 622 of the second coil 608 are located at two opposite sides of the inner side of the layout of the inductor 600 (i.e., the inner area surrounded by the first coil 606 and the second coil 608).

As shown in FIG. 3D, the second coil 608 is located above the first coil 606, the bottom of the first layer 6062 of the first coil 606 directly contacts the second magnetic glue layer 614, and the dielectric layer 610 fills/forms between the first coil 606 and the second coil 608. In another embodiment, an insulating material is between the bottom of the first coil 606 and the second magnetic glue layer 614. The insulating material can be directly formed (without etching) between the bottom of the first coil 606 and the second magnetic glue layer 614, and can also be coated between the bottom of first coil 606 and the second magnetic glue layer 614. However, the cut-off frequency of the inductor 600 without the insulating material can be increased.

Figure 4B:
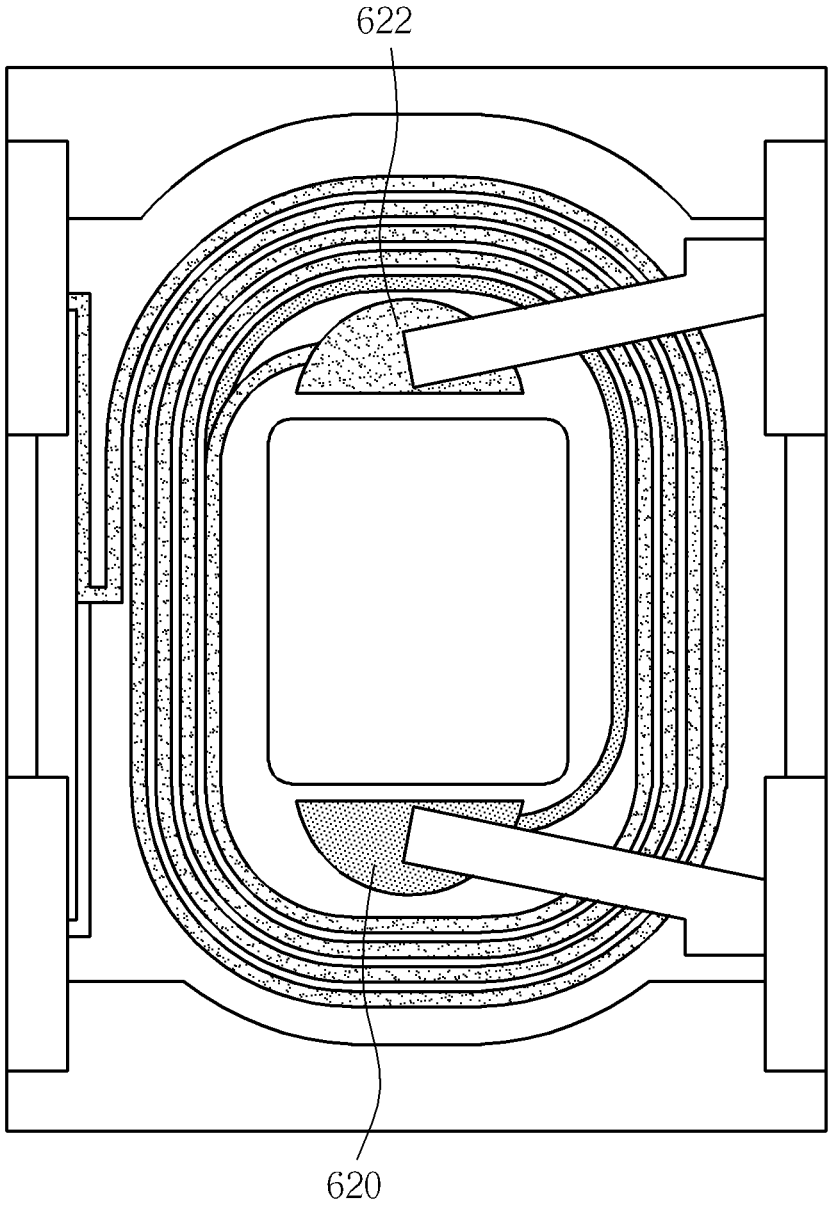
FIGS. 4B and 4C are diagrams illustrating corresponding top views of layouts of the inductor in FIGS. 3D and 3E.
Figure 4C:
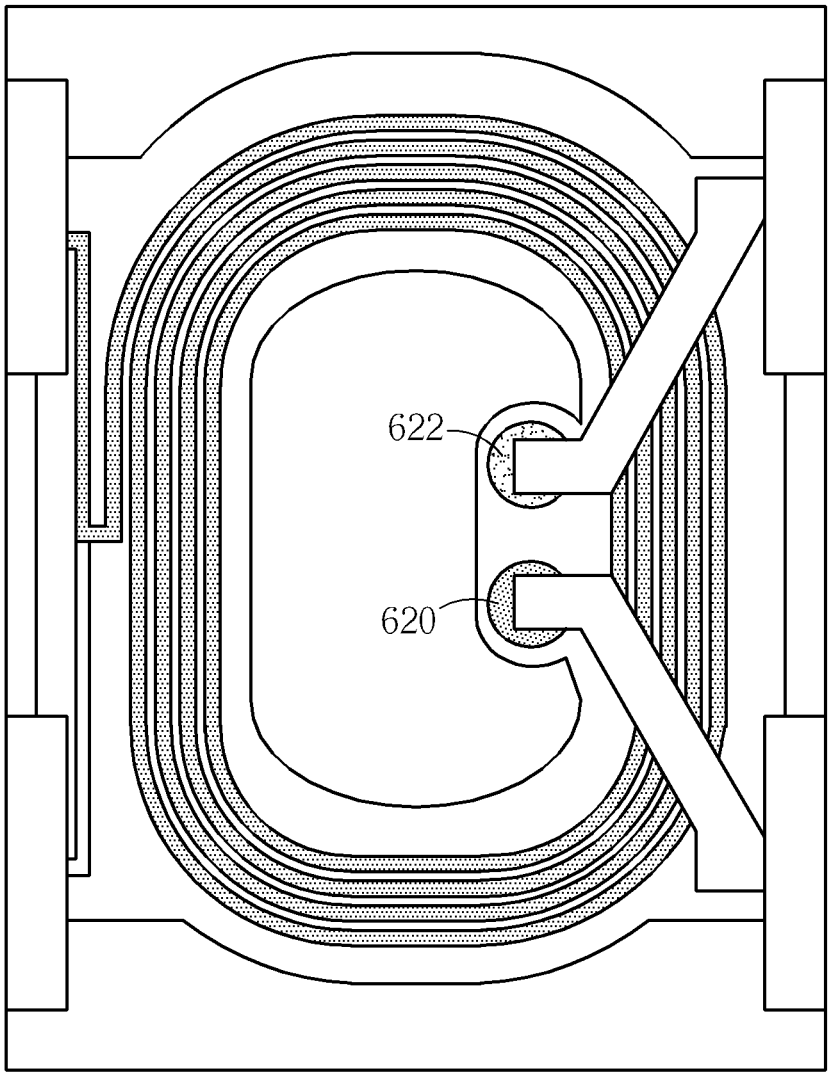

As shown in FIG. 3D, a first via 620 coupled to the first coil 606 and a second via 622 coupled to the second coil 608 are located above the second coil 608. However, the present invention is not limited to the first via 620 and the second via 622 being located above the second coil 608. That is to say, the first via 620 and the second via 622 can be located at any position of the dielectric layer 610 outside the second coil 608 and the first coil 606. In addition, except for the bottom of the first coil 606, the dielectric layer 610 fully covers the first coil 606, the second coil 608, the first via 620, and the second via 622. As shown in FIG. 4B, in the top view of the layout of the inductor 600, the first via 620 coupled to the first coil 606 and the second via 622 of the second coil 608 are located at two opposite sides of the inner side of the layout of the inductor 600 (i.e., the inner area surrounded by the first coil 606 and the second coil 608). In another embodiment, the first via 620 coupled to the first coil 606 and the second via 622 of the second coil 608 are located at the same side of the inner side of the layout of the inductor 600 (i.e., the inner area surrounded by the first coil 606 and the second coil 608) (as shown in FIG. 4C).

As shown in FIG. 3E, the second coil 608 is located above the first coil 606, the bottom (i.e., the exposed bottom portion) of the first layer 6062 of the first coil 606 directly contacts the second magnetic glue layer 614, and the dielectric layer 610 fills between the first coil 606 and the second coil 608. In another embodiment, an insulating material is located between the bottom of the first coil 606 and the second magnetic glue layer 614. The insulating material can be directly formed (without etching) between the bottom of the first coil 606 and the second magnetic glue layer 614, and can also be coated between the bottom of first coil 606 and the second magnetic glue layer 614. However, the cut-off frequency of the inductor 600 without the insulating material can be increased. As shown in FIG. 3E, a first via 620 coupled to the first coil 606 and a second via 622 of the second coil 608 are located above the second coil 608. However, the present invention is not limited to the first via 620 and the second via 622 being located above the second coil 608. That is to say, the first via 620 and the second via 622 can be located at any position outside the second coil 608 and the first coil 606, and the dielectric layer 610 covers a part of the first coil 606 and a part of the second coil 608. In addition, except for the bottom of the first coil 606, an upper part of the first via 620 and an upper part of the second via 622, the dielectric layer 610 covers the first coil 606, the second coil 608, a lower part of the first via 620, and a lower part of the second via 622. As shown in FIG. 4B, in the top view of the layout of the inductor 600, the first via 620 coupled to the first coil 606 and the second via 622 of the second coil 608 are located at two opposite sides of the inner side of the layout of the inductor 600 (i.e., the inner area surrounded by the first coil 606 and the second coil 608). In another embodiment, the first via 620 coupled to the first coil 606 and the second via 622 of the second coil 608 are located at the same side of the inner side of the layout of the inductor 600 (i.e., the inner area surrounded by the first coil 606 and the second coil 608) (as shown in FIG. 4C).

Figure 5A:
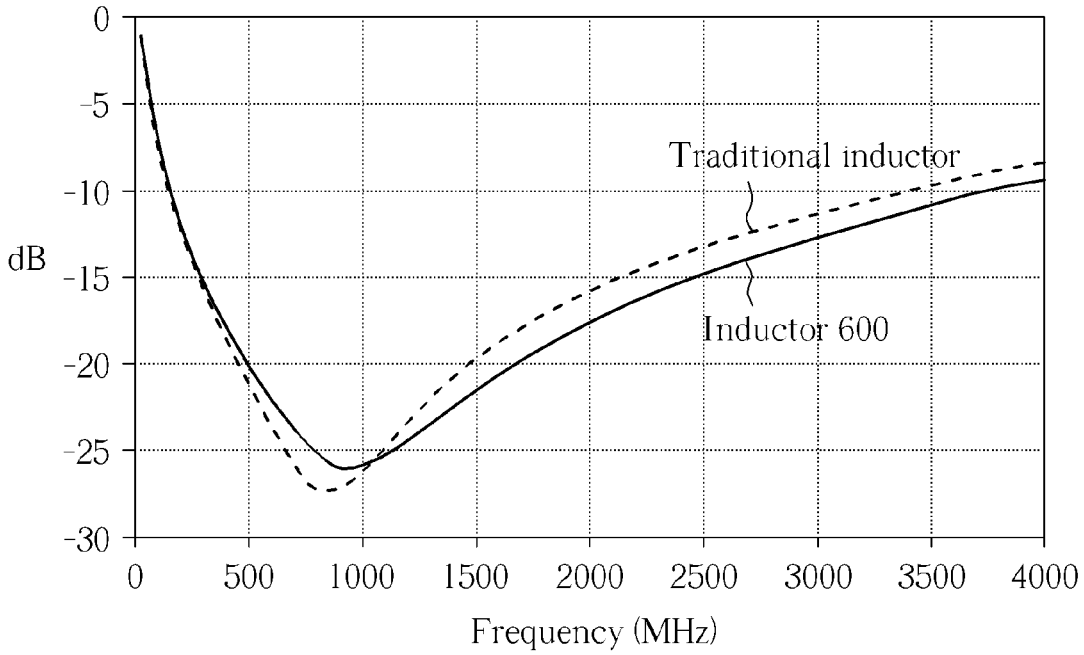
FIGS. 5A and 5B are diagrams illustrating the noise-rejection bandwidth and the cut-off frequency of the inductor and the noise-rejection bandwidth and the cut-off frequency of the conventional inductor.
Figure 5B:
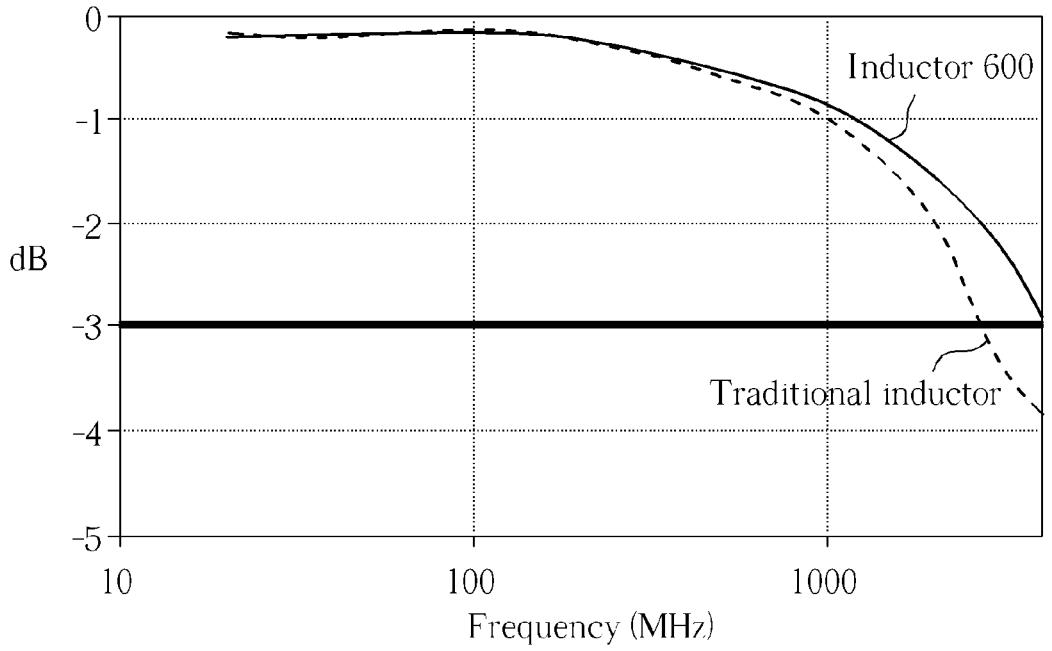

FIGS. 5A and 5B are diagrams illustrating the noise-rejection bandwidth and the cut-off frequency of the inductor 600 and the noise-rejection bandwidth and the cut-off frequency of the conventional inductor. As shown in FIGS. 5A and 5B, the noise-rejection bandwidth (see FIG. 5A) and the cut-off frequency (see FIG. 5B) of the inductor 600 are superior to those of the conventional inductor.

To sum up, the method of producing an inductor with high inductance utilizes the first magnetic glue layer and the second magnetic glue layer to cover the first coil, the second coil, and the dielectric layer. The first magnetic glue layer may be the same as or different from the second magnetic glue layer, and the first magnetic glue layer and the second magnetic glue layer fully enclose the combined structure of the first coil, the second coil and the dielectric layer. The bottom of the first coil directly contacts the second magnetic glue layer, or the bottom of the first coil directly contacts the second magnetic glue layer and the upper part of the first via and the upper part of the second via directly contact the first magnetic glue layer. Unlike the conventional inductor with a traditional magnetic substrate, the present invention has advantages as follows:

First, because either the bottom of the first coil directly contacts the second magnetic glue layer, or the bottom of the first coil directly contacts the second magnetic glue layer and the upper part of the first via and the upper part of the second via directly contact the first magnetic glue layer, and the first coil, the second coil, and the dielectric layer are covered by the magnetic glue layer (the first magnetic glue layer and the second magnetic glue layer have better permeability), the present invention has a wider noise-rejection bandwidth.

Second, because the first magnetic glue layer and the second magnetic glue layer have lower permeability loss, the present invention has a higher cut-off frequency.

Third, the first magnetic glue layer and the second magnetic glue layer are easily implemented through either a thermal-pressure process or a screen-printing process.

Fourth, because the present invention utilizes the flat temporary carrier and the flat removable polymer layer to act as a substrate for stacking the first coil, the second coil, and the dielectric layer, the present invention has an easier lithography process, and the first coil and the second coil have better geometric uniformity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic component, comprising:

at least one coil; and a plurality of insulating layers, wherein the at least one coil is formed by a plurality of conductive layers separated by the plurality of insulating layers, wherein the bottom conductive layer of the plurality of conductive layers comprises a first conductive pattern of the at least one coil and a non-patterned area, wherein the bottom insulating layer of the plurality of insulating layers is disposed on the top surface of the first conductive pattern of the at least one coil and filled into the non-patterned area of the bottom conductive layer; and a first magnetic glue layer, disposed under the bottom conductive layer and being in contact with the bottom surface of the first conductive pattern of the at least one coil, wherein the plurality of insulating layers and the first magnetic glue layer are not supported by a substrate.

2. The electronic component according to claim 1, wherein the at least one coil comprises a first coil, wherein the first magnetic glue layer is disposed under and in contact with the bottom surface of the first coil.

3. The electronic component according to claim 1, wherein the at least one coil comprises a first coil and a second coil, wherein the first coil and the second coil are at two different conductive layers, further comprising at least one via disposed between said two different conductive layers for electrically connecting the first coil and the second coil.

4. The electronic component according to claim 1, wherein the first magnetic glue layer comprises a plurality of magnetic particles, and the grain size of the plurality of magnetic particles is smaller than 100 micrometer.

5. The electronic component according to claim 1, wherein the at least one coil comprises a first coil and a second coil, wherein each of the first coil and the second coil is a spiral conductor pattern.

6. The electronic component according to claim 1, wherein the at least one coil comprises a first coil and a second coil, wherein each of the first coil and the second coil is a spiral conductor pattern, and the spiral conductor pattern of the first coil is magnetically coupling to the spiral conductor pattern of the second coil, wherein respective magnetic flux of the first coil and the second coil cancel with each other when differential-mode currents flow in the first coil and the second coil; and the respective magnetic flux of the first coil and the second coil add up with each other when common-mode currents flow in the first coil and the second coil.

* * * * *